United States Patent [19]

Erb et al.

[11] 4,375,273

[45] Mar. 1, 1983

[54] COMBUSTION AUTOMATIC CONTROL SYSTEM

[75] Inventors: Helmut Erb, Offenbach am Main; Werner Leese, Neu-Isenburg, both of Fed. Rep. of Germany

[73] Assignee: Samson Aktiengesellschaft, Frankfurt am Main, Fed. Rep. of Germany

[21] Appl. No.: 263,067

[22] Filed: May 13, 1981

[30] Foreign Application Priority Data

May 19, 1980 [DE] Fed. Rep. of Germany ..... 3019010
Dec. 23, 1980 [DE] Fed. Rep. of Germany ..... 3048745

[51] Int. Cl.[3] ..... F22B 37/47

[52] U.S. Cl. ..... 236/21 R; 122/504.1; 137/75

[58] Field of Search ..... 236/21 R, 10, 21 B, 236/99 B, 99 G; 122/504.1; 137/72, 73, 75

[56] References Cited

U.S. PATENT DOCUMENTS

| | | | |
|---|---|---|---|
| 344,559 | 6/1886 | Barker | 236/10 |
| 1,048,659 | 12/1912 | Claus | 122/504.1 X |
| 2,649,845 | 8/1953 | Cohen et al. | 236/21 B X |
| 3,981,316 | 9/1976 | Sullivan | 122/504.1 X |

FOREIGN PATENT DOCUMENTS

| | | | |
|---|---|---|---|
| 606721 | 10/1960 | Canada | 122/504.1 |

*Primary Examiner*—William E. Tapolcai
*Attorney, Agent, or Firm*—Watson, Cole, Grindle & Watson

[57] ABSTRACT

The invention is with respect to a fail-safe system for stopping damage to water boilers, whose thermostats are not in working order.

In an automatic combustion control system of the sort having an elastic thermostat bellows element placed within an outer shell within the water space of a boiler and joined by a chain or the like with the air door for controlling the air inlet rate at some point in the connection between the thermostat element and the door, there is a temperature-sensitive part, for example in the form of a plug of fusible metal or collapsing material, or in the form of a soldered join using a special fusible solder.

In one form of the invention, this temperature-sensitive part may take the form of a ring of temperature-sensitive material placed at one end of a spring which is forced together on the temperature increasing. On damage to the thermostat element, the one end of the spring will no longer be supported so that the spring will no longer take effect and so let the air door be moved down under its own weight into the shut position.

In a further form of the invention, a body of temperature-sensitive material is placed between a rod, acting on one end of the thermostat element and a turning head which is used for making adjustment in the desired temperature.

In a further form of the invention, the temperature-sensitive part takes the form of a plug of temperature-sensitive material between the end of a gripping screw in a jointpiece and a turning rod acted upon by said screw.

In a still further form of the invention, the temperature-sensitive part takes the form of a bimetallic wing, which is unhooked from a jointpiece on being heated to a limit temperature. As part of a still further form of the invention, a guide roller for a chain joining the thermostat with the air door is fixed to the side of the boiler by way of fusible solder, this taking the form of the temperature-sensitive part.

2 Claims, 20 Drawing Figures

Fig. 14
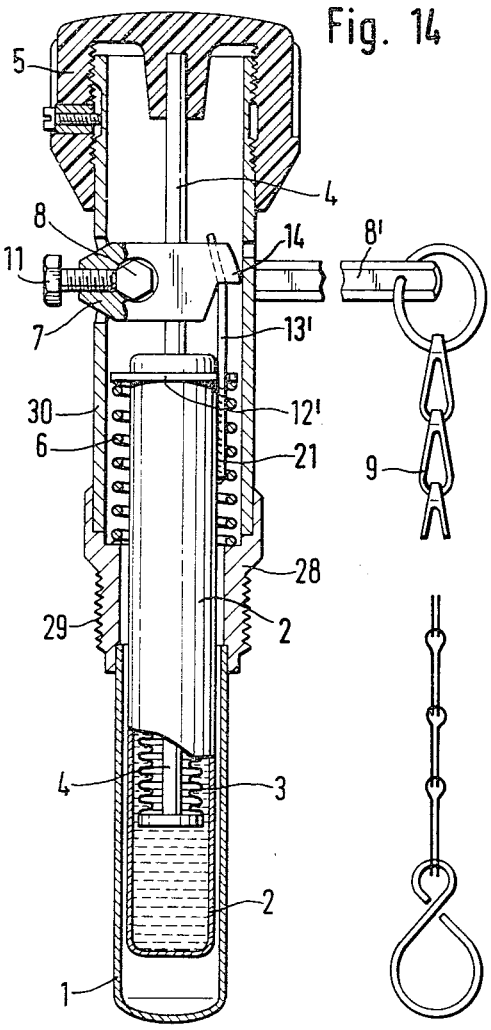
Fig. 16
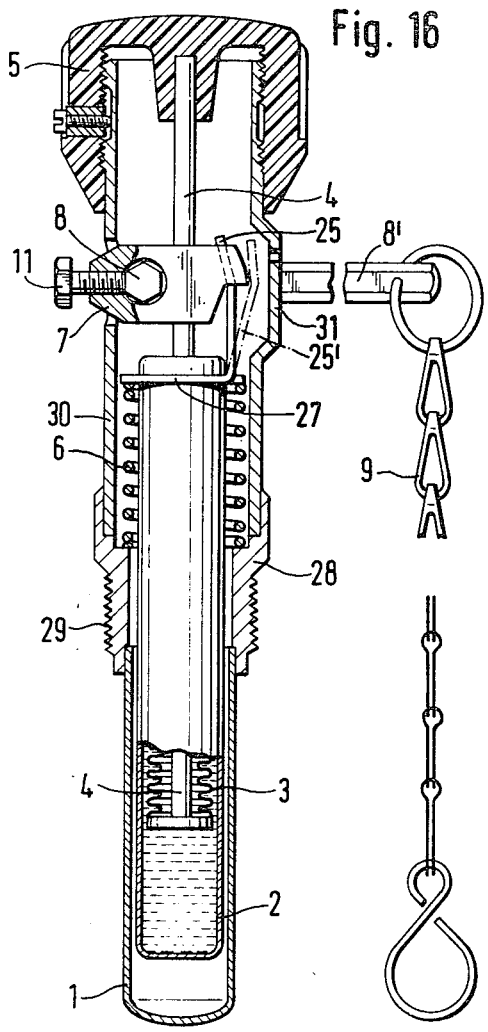
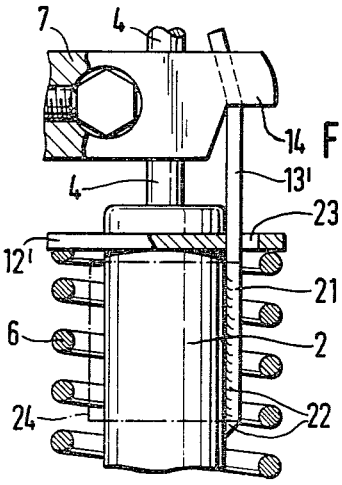
Fig. 15
Fig. 17
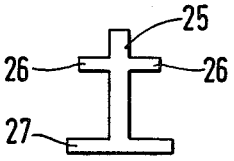

COMBUSTION AUTOMATIC CONTROL SYSTEM

BACKGROUND OF THE INVENTION

The present invention relates to a combustion automatic control system for the flow or water temperature of water heaters such as boilers, with an expansion thermostat, acted by the water theater temperature, and placed in a control system housing, the thermostat being joined up by way of a lever linkage or the like in the form of a connection apparatus for controlling the position of the air inlet or fire door of the water heater, such door being oppositely acted upon by a spring force or by gravity. Such combustion automatic control systems have long been used, more specially as temperature controllers without any servo effect, for boilers and other water heaters fired by solid fuel, for example a boiler designed for solid fuel only, such as coke or coal, or one designed for two forms of fuel such as coke and oil or coke and gas. In the present specification the term "water heater" is used for describing a direct central heating boiler or an indirect boiler for producing hot water for other purposes than heating, in the home, in trade or in industry in a widely different number of designs. Such solid fuel fired water heaters have of late started becoming more and more important because of the oil shortfall.

An expansion thermostat placed within the control system housing and worked by the thermal expansion of a liquid, by vapor pressure or by gas absorption, is, more specially because of the use of an elastic metal bellows, as such not very strong in structue and likely to be damaged. The motion of the bellows, which is, generally speaking, small in size, is stepped up by a lever system or other linkage for producing a large enough control motion for driving the draft, air or fire door of the boiler, the force of the thermostat working in the opening-direction of the air or fire door against gravity, for example the weight of the door itself or against the force of a spring or other energy storing unit having the tendency of shutting the door. For this reason, a chain, joined with the thermostat is kept tight at all times in normal operation. For causing opening of the draft or fire door on a change in length of the thermostat, the system furthermore has parts producing forces or turning forces greater than the force of the door acting on the connection apparatus or linkage. Generally, such parts take the form of springs although in the past weights have been used as well. More specifically, a combustion automatic control system of this sort furthermore has a unit for adjustment of the desired temperature value, for example in the form of a turning head with a scale placed on the housing of the automatic control system and having within it the thermostat, the return spring and the linkage. The thermostat is generally placed within an immersed pipe-like housing within the water space of the boiler.

If in the case of such a combustion automatic control system there is a trouble condition with respect to the thermostat, for example because of its no longer being liquid-tight, it will be decreased in length and go into that position which a thermostat in full working order goes into when the water is cold. For this reason, the output signal of the thermostat seems to be that representative of a low temperature, with the outcome that the fire door is opened and this may be responsible for serious damage to the boiler if, for example, it is boiled dry.

SUMMARY OF THE INVENTION

One purpose of the present invention is that of stopping any such boiler damage and other trouble conditions in the heating plant. While it would be possible, to make the system safer, to have a second combustion automatic control system acted upon by the same temperature, this would be responsible for a marked increase in price and generally make the system more complex. Furthermore, any such second safety control system might get out of order as well, for example if its thermostat is no longer liquid-tight.

For effecting this purpose and further purposes, in the present invention in or on the housing of the automatic control system, at a position where it is acted upon by the temperature of the boiler, there is a temperature-sensitive part which, when its temperature is increased over a limit temperature, has the effect of shutting down the automatic control of the draft or fire door and causing automatic shutting of the same.

One useful effect of this system is that it is not only very simple and low in price, but may furthermore be used in a safe and trouble-free way, for stopping all damage and trouble conditions in connection with the boiler and the heating system because the draft or fire door is acted upon by a fail-safe system before being in danger of overheating in every case automatically so that there is a no chance of an overly high temperature being produced.

It may be seen that the invention makes use in a surprisingly simple way of the fact that the automatic control system housing, fixed on or in the boiler, and the parts placed therein, have a high-level thermal connection with the immersed pipe-like housing of the thermostat within the boiler and at the outer face the temperature will be at least generally equal to the temperature of the immersed pipe-like housing so that changes in the temperature of the last-named will be responsible for nearly equal changes in the temperature of the automatic control system housing and the parts therein, the function of the system being made better the less the difference between the temperature of the control system housing and that of the immersed pipe-like housing. By taking certain measures, such as heat insulation or by insulating the housing, it is readily possible to make certain that the temperature difference between the housing and the immersed pipe-like sleeve is kept small enough. Furthermore, a useful effect is produced if the housing is made of a material with the highest possible thermal conductivity.

A heating engineer will be able to make use of the general teaching of the present invention in a number of different ways. The system may be so designed, as part of the invention, that the temperature-sensitive part, on being heated to the limit temperature, has the effect of cutting off the driving connection between the thermostat and the return spring and, in this case, the tempraturе-sensitive part may take the form of a body, as for example one which is melted or is collapsed at the limit temperature, taking on a form or position in which it is of no effect at the limit temperature. In this respect, the property of certain materials is used of melting at low temperatures as for example low melting point solders, some sorts of wax or low melting point salts. Furthermore, it is, however, possible for the collapsing body to take the form of a bottle of glass or other brittle material filled with a liquid undergoing expansion on an increase in temperature. On getting to the limit temperature, the bottle will then be burst, that is to say collapsed, and have no further effect as part of the connection apparatus. In the combustion automatic control system, the temperature-sensitive part may, for example take the form of a support for at least one end of a return spring housed in the housing of the automatic control system.

In the case of a further working example of the invention, the driving connection between the fire door and the thermostat may be shut down with the help of a temperature-sensitive coupling which, as part of a further development of the invention of good effect, may take the form of a design in which a driving ear, drivingly joined with a jointpiece journalled in the housing of the automatic control system, has a tailpiece which is soldered to the outer face of the thermostat casing.

Furthermore, as part of the invention, it is possible for the temperature-sensitive part to be in the form of a bimetallic wing, placed between the thermostat and the draft or fire door and having the function of cutting off the driving connection when the temperature is increased.

These forms of the invention noted so far do, however, make necessary a special design of the thermostat for automatic control. However, the same effects may be produced with the help of a combustion automatic control system of any design, this being made possible in the invention if the temperature sensitive part is within the path of the power or driving connection joining the connection apparatus or lever system of the automatic control thermostat with the draft or fire door of the boiler or water heater. In this way it is possible for any desired automatic control thermostat or combustion automatic controller to be used as part of the invention.

As part of a preferred form of the invention, the connection part, for example a chain, joining the connection apparatus of the automatic control thermostat with the draft or fire door of the boiler, is kept pulled tight in its position of operation by a temperature-sensitive part which is placed at a position of the boiler acted upon by the temperature produced. This system may be very simply designed by having the chain or the like running over guide roller, whose support is fixed to the boiler so as to make up the pressure-sensitive part and, for doing this, it is possible for a base-plate of the support of the guide roller to be fixed to the wall of the boiler by a safety solder or fusible metal or the like.

BRIEF DESCRIPTION OF THE DRAWINGS

FIG. 14 is a longitudinal sectional view taken through a combustion automatic control system as a fourth example of the invention with a soldered-on driving ear.

FIG. 15 is a view on a larger scale of part of the structure of FIG. 14 with the soldered-on driving ear and with a possible differentform of this system.

FIG. 16 is a longitudinal sectional view taken through a combustion automatic control system as a fifth working example of the invention with the driving ear in the form of a bimetallic wing.

FIG. 17 is a front view of one possible form of the driving part.

DETAILED ACCOUNT OF WORKING EXAMPLES OF THE INVENTION

Firstly, the general design of a combustion automatic control system according to FIGS. 1 to 5 will be described. This control system is only as taken to be an example and as the starting point for a number of different working examples of the invention fully detailed below are some of the possible forms of the invention for producing the invention's useful effects.

Figure 1:
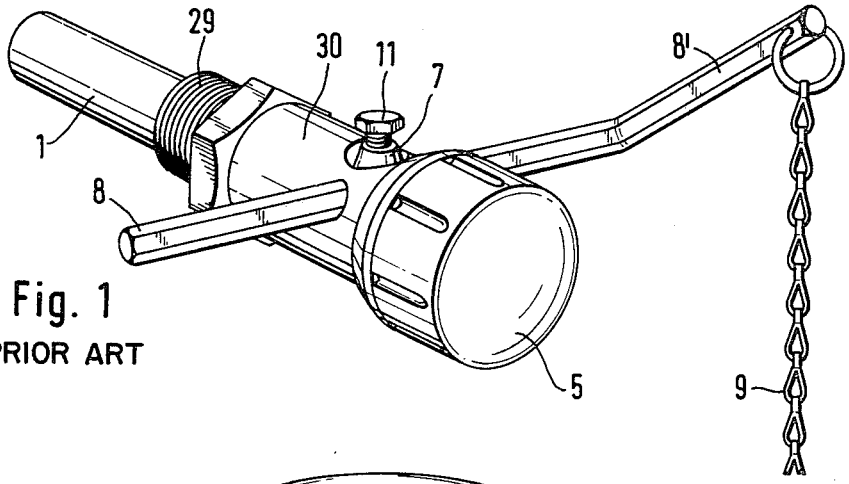
Fig. 1 PRIOR ART
FIG. 1 is a perspective view of a known combustion automatic control system disposed horizontally.
Figure 2:
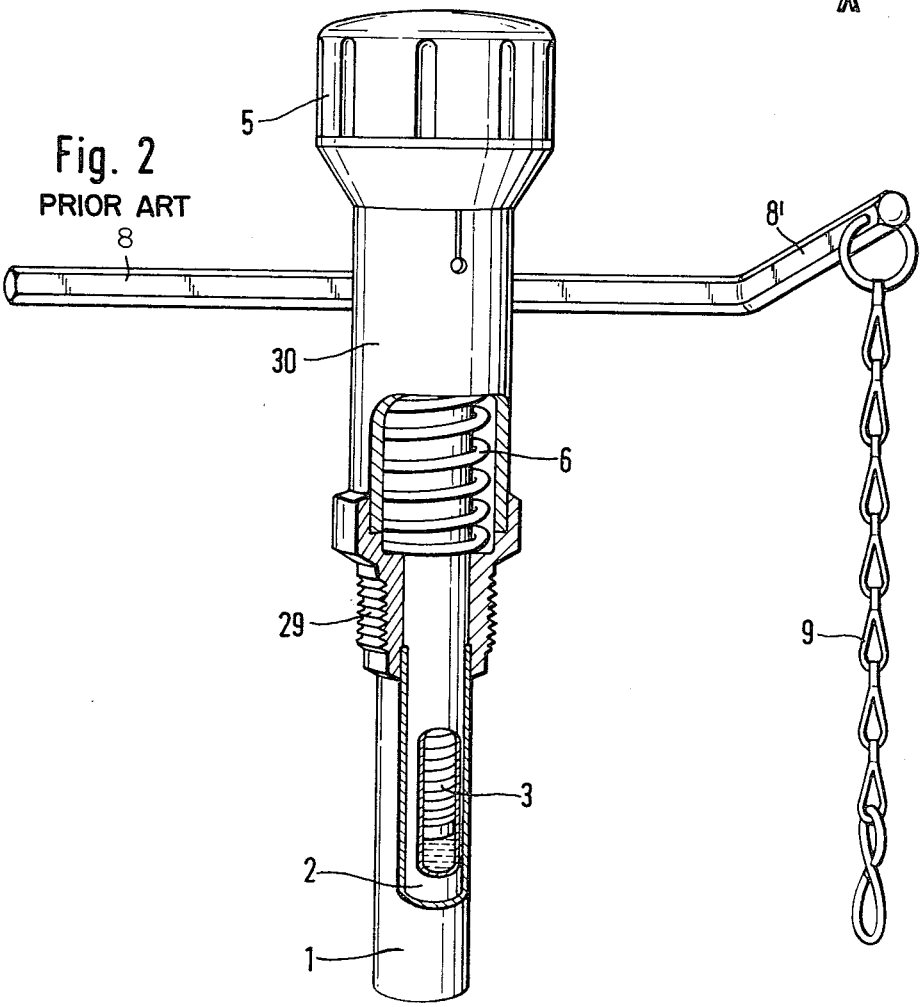
Fig. 2 PRIOR ART
FIG. 2 is the perspective view of a combustion automatic control system whose housing and immersed casing wall is shown partly in section, the system being disposed upright.
Figure 3:
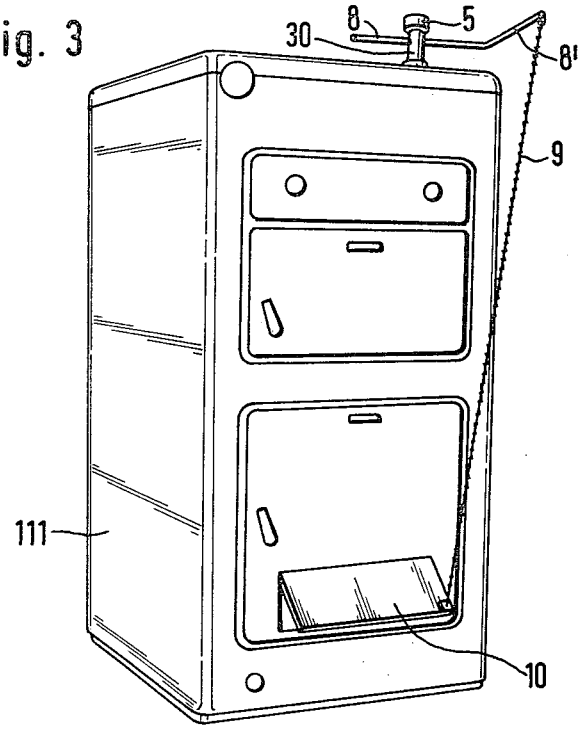
FIG. 3 is a perspective of a direct hot water supply boiler for solid fuels, the combustion automatic control system being therein mounted in an upright position.
Figure 4:
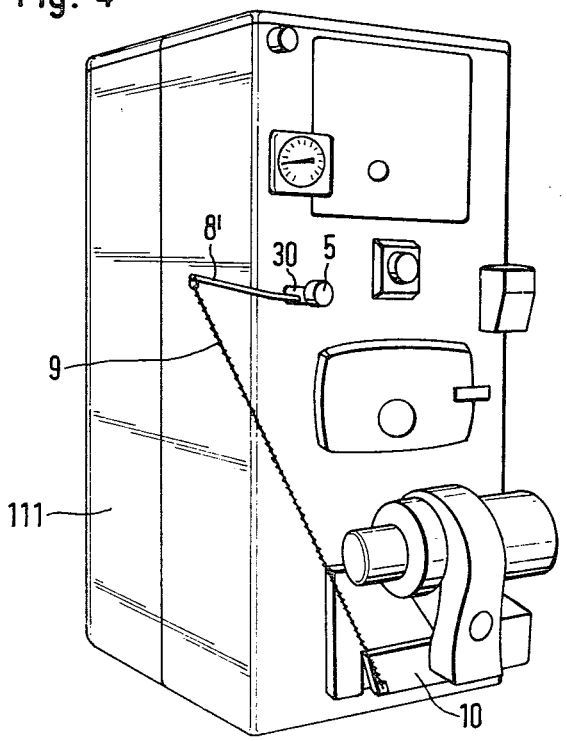
FIG. 4 is a perspective view of a boiler designed for two types of fuel (coke or oil) with an automatic control system therein mounted in a horizontal position.
Figure 5:
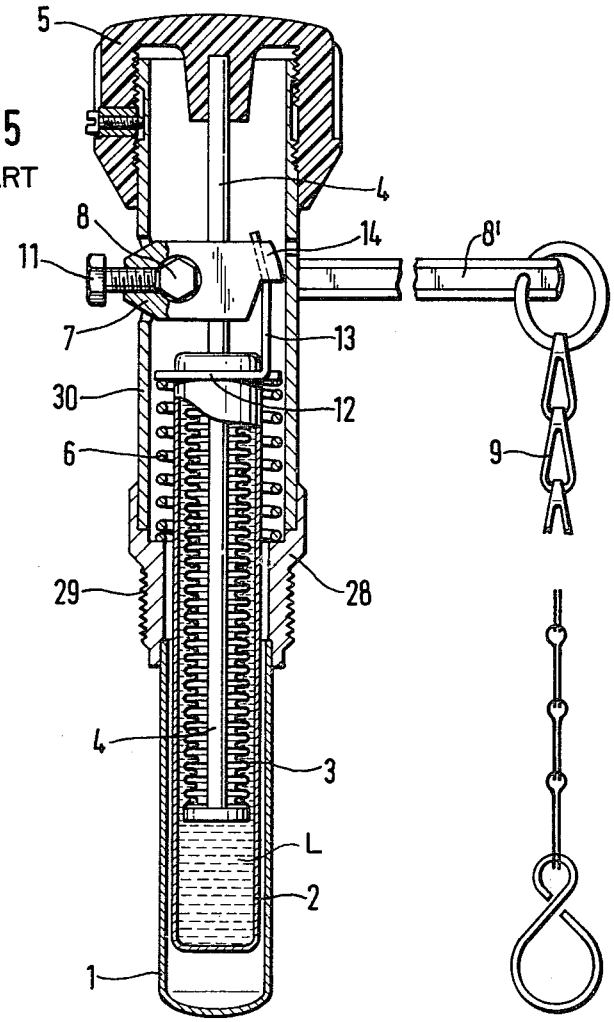
Fig. 5 PRIOR ART
FIG. 5 is a longitudinal sectional view taken through the automatic control system of FIGS. 1 and 2.

In the present example of a combustion control system a generally pipe-like thermostat 2 is positioned in an immersed casing 1 so that, in operation, the thermostat's temperature increases to the temperature of the flow water heated by the boiler. A pin 4, fixed to the lower end of a metal bellows 3 extends outwardly of the thermostat 2 which comprises an outer shell, a spring plate 12 affixed to the upper end of the shell, sealed bellows 3 within the shell and an expansion liquid L within the liquid-tight space between the bellows and the shell. Pin 4 rests against a turning head 5 (for adjustment of the desired water temperature) which is preferably of thermally insulating material, and has temperature scales for an upright and for a horizontal position of the control system. The part of the system including the thermostat 2 and the pin 4 is forced by a spring 6 against a bearing in turning head 5 without interfering with the turning of the head by hand. The thermostat 2 is connected with a jointpiece in which a lever rod 8 , having an angled lever arm 8', is fixed by means of a set screw 11. At the free end of the lever arm 8' a chain 9 is fixed, whose lower end is hooked into an eye on draft door 10 on the firebox door of the boiler 111 (FIGS. 3 or 4). Such a combustion automatic control system may be disposed in an upright (FIG. 3) or in a horizontal position (FIG. 4) depending on the design of the boiler. For connecting the thermostat 2 with the jointpiece 7, an upwardly extending driving ear 13 is provided and is connected with a top spring plate 12 of thermostat 2, the ear 13 having a design for example as in FIG. 17 in the form of a double cross, whose cross-arms are disposed loosely beneath a nose 14 defined by a cutout of the jointpiece 7. The immersed casing 1, in which thermostat 2 is placed so that it may be taken out if a new thermostat is needed, is for avoiding damage to the boiler if there is any loss of liquid from the thermostate. Casing 1 is fixed in a threaded collar 28, having a male thread 29 engaging a female thread in the boiler wall. An automatic control system housing 30 is fixed on threaded collar 28 for extending outwardly of the boiler, turning head 5 being threaded on to its top end.

The spring 6 is so stiff in design that the weight of the draft door 10 in the firebox door of the boiler is not responsible for any change in position of the parts of the automatic control system. If now the temperature of the water in the boiler increases for example, there will be an expansion of the liquid within the thermostat 2, thus decreasing the length of the bellows 3 of the thermostat. Because the plate at the lower end of the bellows is prevented from moving upwardly by rod 4, spring plate 12 is forced downwardly thereby compressing spring 6, making it possible for jointpiece 7 to be turned downwardly together with the angled arm 8' of lever rod 8, lever rod 8 being rotated clockwise when viewed in FIG. 5 (as its arm 8' is pulled downwardly) as caused by the weight of the air floor 10. For this reason, the door will be shut somewhat further, thus decreasing the draft so that the desired boiler temperature is produced. If the boiler temperature decreases below the desired temperature, the liquid within the thermostat 2 will occupy less space so that now, by the force of spring 6, plate 12 will be moved upwardly turning lever rod 8 about its axis in a counterclockwise direction and, by way of lever arm 8' and chain 9, the air door 10 is opened somewhat farther, this causing the boiler temperature to be increased. For adjustment to obtain a different water temperature head 5 for adjustment of the desired temperature is turned and if, for example, because of a lower outside temperature, a higher boiler temperature is desired, turning head 5 is turned to effect movement of the thermostat 2 and the pin 4 in an upward direction. Thus, draft door 10 is opened somewhat farther so that its upward and downward movements in response to changes in temperature will increase relative to a somewhat higher point pertaining to the higher temperature desired.

In the case of any trouble condition in the automatic control system, because, for example, of loss of liquid from thermostat 2 resulting in an extreme increase in the boiler temperature, precautions must be taken to assure that, nevertheless, the draft door 10 of the boiler is automatically closed and, for this purpose, as part of the invention, the driving connection between the automatic control system and the air door of the boiler is cut off in such a way that the desired automatic shutting of the air door takes place under its own weight or, if desired, because of some other effect. This teaching may be put into effect in a number of different ways.

Figure 6:
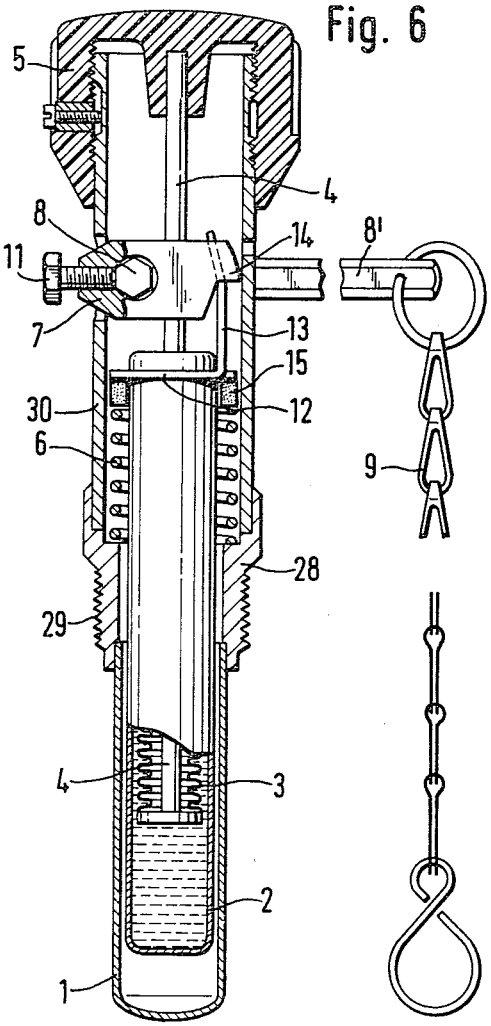
FIG. 6 is a longitudinal sectional view taken through an automatic control system forming part of a first form of the invention with a temperature-sensitive part having the top end of the return spring resting thereagainst.
Figure 8:
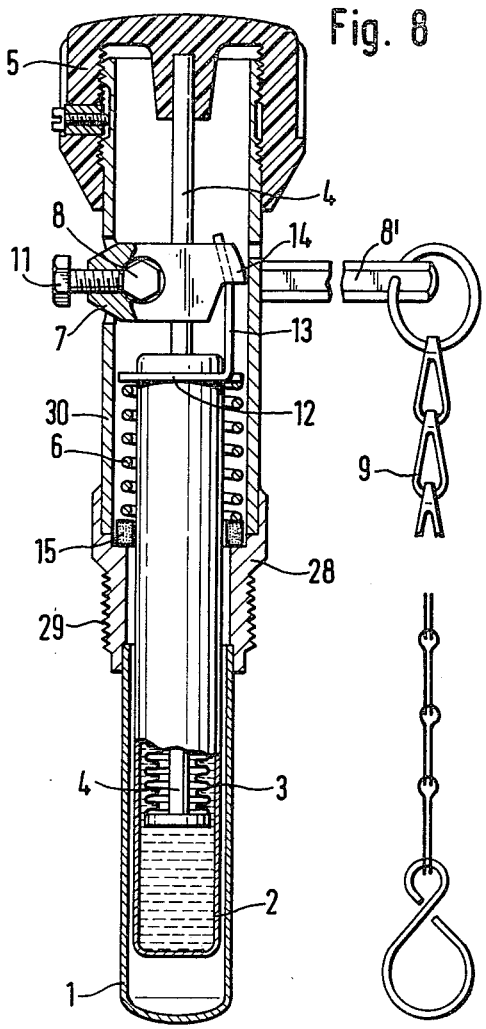
FIG. 8 is a longitudinal sectional view taken through an automatic control system somewhat different to that of FIG. 6 with a temperature-sensitive part having the lower end of the spring resting against it.
Figure 7:
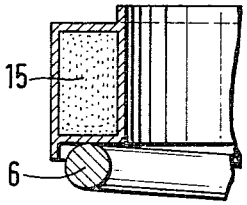
FIG. 7 is a view, on a larger scale, of the top support end for the spring shown in FIG. 6.
Figure 9:
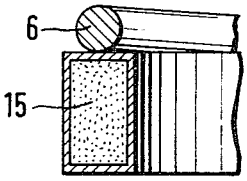
FIG. 9 is a view on a larger scale of the support for the lower spring end of FIG. 8.

In the example according to FIGS. 6 and 7 there is, between the top spring plate 12, connected with the thermostat 2 and top end of the return spring 6, a temperature-sensitive element 15 against which the top end of the spring rests within the system housing. Element 15 is said to be temperature-sensitive in the sense that it is fused or collapsed at a limit temperature. In the case of the further development of the invention according to FIGS. 8 and 9, the temperature-sensitive element 15 is disposed between the lower end of return spring 6 and an inwardly extending lip of threaded collar 28, which would otherwise have this spring resting against it. If desired, it would be possible to have two such temperature-sensitive elements 15, one at the top (as in FIGS. 6 and 7) and one at the lower end of the spring (as in FIGS. 8 and 9). Because the system housing 30, the threaded collar 28 and the spring 6 generally elevate to the full temperature of the boiler, the temperature-sensitive element 15 will be melted or collapsed on approaching the limit temperature and will then yield so that the force of spring 6 will decrease to zero or near zero and the system will be overpowered by draft door 10 so that the same will be automatically shut.

Figure 10:
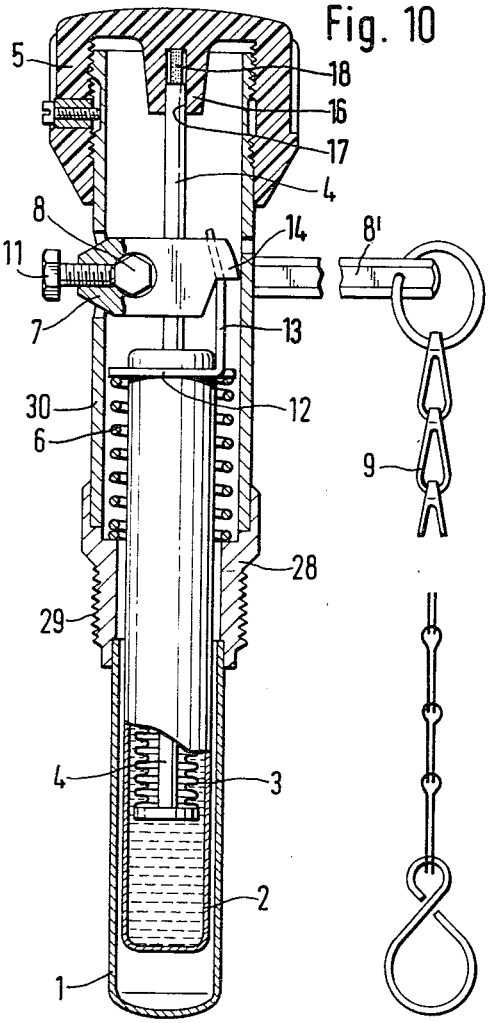
FIG. 10 is a longitudinal sectional view taken through a combustion automatic control system as a second working example of the invention with a temperature-sensitive part placed within the turning head used for making temperature adjustments.
Figure 11:
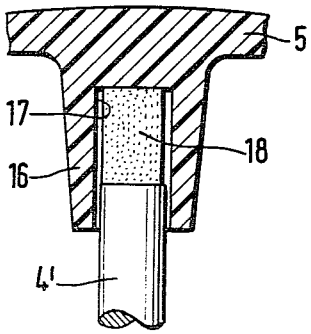
FIG. 11 is a view on a larger scale of a part of the temperature adjustment head of FIG. 10.

In FIGS. 10 and 11, the turning head 5 of the automatic control system has within it a temperature-sensitive element 18, which may be melted or burst at an extreme temperature, having the top end 4' of pin 4 resting against it, end 4' extending into only a portion of a hole 17 in the hollow guide 16. Element 18 lies in the space in the hole over the end pin 4' and, because it contacts pin end 4', maintains the same temperature as the boiler or a temperature only slightly less than the temperature of immersed casing 1. However, the temperature of the temperature-sensitive element will be high enough, that is to say near enough to the boiler temperature, for the element to be melted or collapsed if there is any danger of an excessive temperature. Pin 4 will then no longer be supported, that is to say pushed downwardly, spring 6 then forcing spring metal bellows 3 together with the driving ear 13 and the right hand part of jointpiece 7 so far in an upward direction that the driving ear 13 is unhooked from nosepiece 14 (which is made short enough for this to occur) of jointpiece 7, and once this occurs, jointpiece 7 will drop downwardly, the weight of draft door 10 causing a turning of lever rod 8, and draft door 10 being shut.

Figure 12:
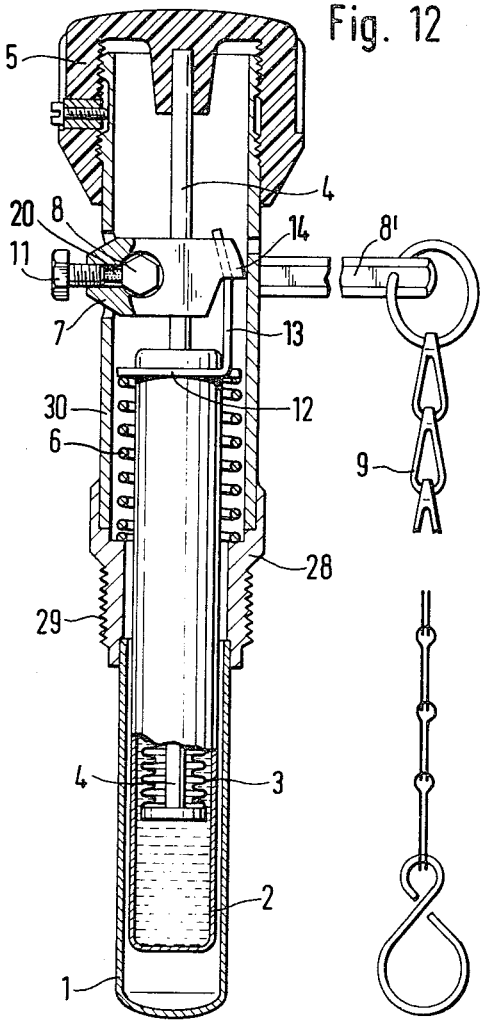
FIG. 12 is a longitudinal sectional view taken through a combustionautomatic control system as a third working example of the invention with a temperature-sensitive part in the jointpiece.
Figure 13:
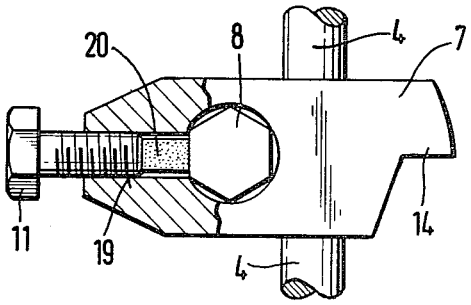
FIG. 13 is a view on a larger scale of the jointpiece of FIG. 12.

A further working example for effecting the purpose of the invention, that is to say stopping the driving connection between the automatic control system and the air door on overheating of the boiler, is so designed that the driving connection between the jointpiece 7 and the lever arm 8 is overcome, or, in other words, lever arm 8 is disconnected from jointpiece 7. In FIGS. 12 and 13, this is effected by placing between the end of screw 11, screwed into a threaded hole 19 in jointpiece 7, and the, for example, six-sided outer face of lever rod 8, a temperature-sensitive element 20 which is melted or collapsed when overheated. Heating of this element is more specially by way of the jointpiece 7, when the boiler is overheated so that it soon gets to a temperature at which it is melted or collapsed. Then lever rod 8 is able to be freely turned and is in fact so turned under the effect of the weight of draft door 10 which accordingly closes.

FIGS. 14 and 15 of the drawing are views of an especially useful and very trouble-free working example of the invention, in which case the driving ear 13' is not fixed to the spring plate 12' of thermostat 2, but has a tailpiece 21 extending through an opening 23 in spring plate 12', under which tailpiece 21 is soldered as at 22 (FIG. 15) to the outer face of thermostat 2. For producing a better supporting effect, the ear tailpiece 21 may extend beneath spring plate 12' in the form of a collar 24 or cuff surrounding the thermostat 2, on which it is fixed by fusible solder 22. Normally the driving ear 13' is moved together with the thermostat 2 with which it is joined and has its effect on jointpiece 7. If, however, because of a trouble condition of the thermostat, there is overheating, the increasing temperature of the automatic control system housing will have the effect of melting the fusible solder 22, spring 6 then no longer producing any force acting against jointpiece 7, the weight of draft door 10 now forcing the door downwardly into its closed position.

In FIGS. 16 and 17, use is made of a bimetallic connection and for this purpose a form of system, for example of the type noted, may have the driving ear taking effect on the jointpiece 7, may be in the form of a bimetallic wing 25 (FIG. 17), whose lower foot part 27 takes the form of the spring plate fixedly joined to the thermostat 2. If now the temperature in the automatic control system becomes greater than the limit temperature, the bimetallic wing 25 will be bent into a position 25' shown in phantom outline in FIG. 16, the cross-arms 26 (FIG. 17) then clearing nosepiece 14 of the jointpiece 7. The housing 30 of the automatic control system may be hollowed out at 31 for accommodating movement of the bimetallic wing between its positions 25 and 25'. By operation of the bimetallic wing, the driving connection between the jointpiece 7 and the thermostat 2 is cut off. In this case spring 6 will not be responsible for any torque or turning force acting on lever arm 8' so that the connection apparatus will become loose and the door 10 will be moved down by its own weight into its closed position.

Figure 18:
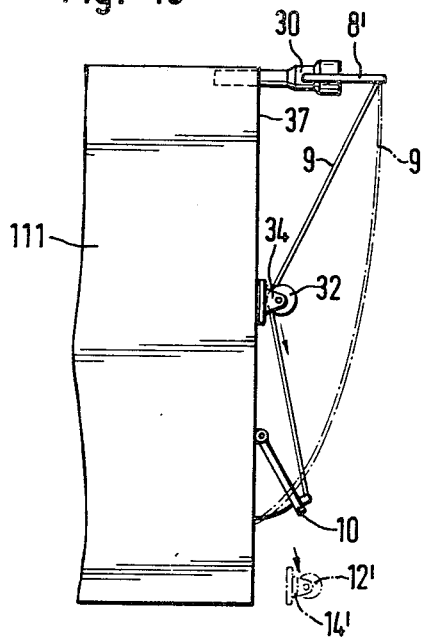
FIG. 18 is a diagrammatic view of the system for guiding a connection chain using a guide roller.
Figure 19:
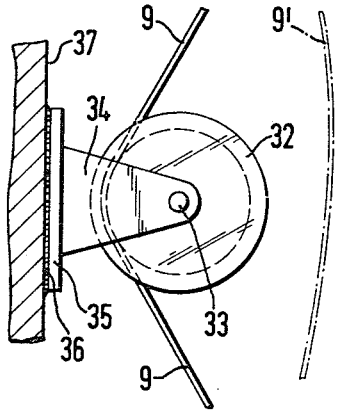
FIG. 19 is a view on a larger scale of the system for fixing the guide roller to a boiler.
Figure 20:
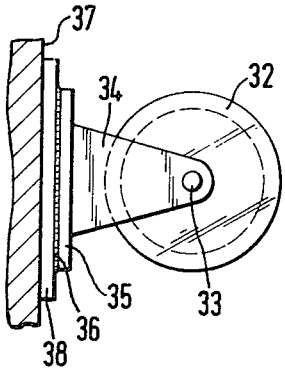
FIG. 20 is a view of a further possible form of the manner of fixing the guide roller in position.

In FIGS. 18 to 20, the chain 9 (or a cord) is guided over a guide roller 32 having a groove and which is journalled on a pin 33 in a roller support 34. This support and its base plate 35 is fixed (FIG. 19) by a fusible solder 36 directly on a wall face 37 of hot water boiler 111.

If now the boiler is overheated, melting fusible solder 36, bearing support 34 with guide roller 32 will be disconnected from the outer face 37 of the boiler and dropped therefrom. The pulling force of chain 9 will now decrease to zero, the acting length of the chain being accordingly increased so that the air door 10 will be automatically shut. Chain 9 will then be moved out of the pulled-tight position shown in solid outline into its loose position 9' shown in phantom outline.

As will be seen from the further development of FIG. 20, it may be suitable for the base plate 35 not to be soldered onto the outer face of the boiler wall itself, but to make use of an interposed plate 38 which is fixed to the boiler wall 37, for example by welding. In this case the fusible solder 36 will be between this plate 38 and the base plate 35 of bearing support 34 for roller 32.

The forms of the invention as herein above described are as taken to be examples of good effect, but which, however, do not have a limiting effect on the field covered by the invention, the same in fact covering all other further developments and changes therein inasfar as they put into effect the principle teachings of the invention. As an example, a thermo-element may be used in the invention, whose hot junction is on or in the housing of the combustion automatic control system while the cold junction is at some distance from the combustion automatic control system on the boiler and will be at a temperature equal to the air temperature within the boiler room.

The thermal emf then produced between the two soldered joints may them, acting through an electromagnet or the like, have the effect of unclutching a coupling in the automatic control system housing, in the case of boiler overheating, so that the draft air door of the firebox goes back into its shut position.

The embodiments of the invention in which an exclusive property or privilege is claimed are as follows:

1. In a combustion automatic control system to be acted upon by the temperature of water within a fired water heater, having an expansion thermostat to be acted upon by the water and placed in a control system housing, joined with said water heater, and a connection apparatus joining said thermostat with a combustion air inlet door of said water heater for changing the position of said door when the temperature of said thermostat is changed, the improvement wherein the system has, in connection with the housing, a temperature-sensitive element comprising a force-transmitting part joining said thermostat with said connection apparatus, and said temperature-sensitive element being joined by a fusible solder capable of fusing when heated over a predetermined limit temperature at the housing, so as to be effective for stopping automatic control of the door and causing the same to be automatically shut, and said connection apparatus having a driving ear, a housing of said control system, a jointpiece journalled in said housing, said ear drivingly acting on said jointpiece, and said ear having a tailpiece joined by the fusible solder with the thermostat.

2. The combustion automatic control system as claimed in claim 1, wherein said tailpiece of said ear comprises a collar surrounding said thermostat and being soldered thereto by the fusible solder.

* * * * *